US010606184B2

(12) United States Patent
Ikeda

(10) Patent No.: US 10,606,184 B2
(45) Date of Patent: Mar. 31, 2020

(54) IMAGE FORMING APPARATUS

(71) Applicant: FUJI XEROX CO., LTD., Tokyo (JP)

(72) Inventor: Akira Ikeda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/170,284

(22) Filed: Oct. 25, 2018

(65) Prior Publication Data

US 2019/0294071 A1 Sep. 26, 2019

(30) Foreign Application Priority Data

Mar. 22, 2018 (JP) ..... 2018-053955

(51) Int. Cl.
*G03G 15/02* (2006.01)
*G03G 5/07* (2006.01)
*G03G 21/10* (2006.01)

(52) U.S. Cl.
CPC ..... *G03G 15/0225* (2013.01); *G03G 5/07* (2013.01); *G03G 21/10* (2013.01); *G03G 2215/00957* (2013.01); *G03G 2221/0005* (2013.01)

(58) Field of Classification Search
CPC ..... G03G 5/07; G03G 15/0225; G03G 21/10; G03G 2215/0005; G03G 2215/00957
See application file for complete search history.

(56) References Cited

U.S. PATENT DOCUMENTS

2003/0059234 A1* 3/2003 Sasaki ..... G03G 15/065 399/237
2006/0188296 A1* 8/2006 Jaskowiak ..... G03G 15/0818 399/266
2007/0217840 A1* 9/2007 Yamana ..... G03G 15/06 399/340
2016/0093908 A1* 3/2016 Kitoh ..... H01M 8/1069 156/243

FOREIGN PATENT DOCUMENTS

JP 09-090716 A 4/1997
JP 10-123838 A 5/1998
JP 2000-181251 A 6/2000

* cited by examiner

*Primary Examiner* — Gregory H Curran
(74) *Attorney, Agent, or Firm* — Sughrue Mion, PLLC

(57) ABSTRACT

An image forming apparatus includes a draw-up member that draws a liquid developer containing oil and toner up from a storage part in which the liquid developer is stored while rotating; a cylindrical member that is disposed so as to face the draw-up member, receives the liquid developer from the draw-up member while rotating, and has a circumferential surface on which a film of the liquid developer is formed, the cylindrical member having an elastic part having a circular cross section and a coating film that covers the elastic part and is made of a copolymer of tetrafluoroethylene and perfluoroalkyl vinyl ether; and a formation member having a circumferential surface on which an image is formed by the liquid developer received by the cylindrical member.

12 Claims, 13 Drawing Sheets

FIG. 8

| | MATERIAL OF COATING FILM | THICKNESS OF COATING FILM OF DEVELOPMENT ROLLER [μm] | THICKNESS OF COATING FILM OF HOLDING ROLLER [μm] | OUTPUT IMAGE EVALUATIONS | | |
|---|---|---|---|---|---|---|
| | | | | SOLID IMAGE EVALUATION | MISSING DOT EVALUATION | IMAGE UNEVENNESS EVALUATION |
| EXAMPLE 1 | PFA RESIN | 300 | 300 | ACCEPTABLE | ACCEPTABLE | ACCEPTABLE |
| EXAMPLE 2 | PFA RESIN | 200 | 200 | ACCEPTABLE | ACCEPTABLE | ACCEPTABLE |
| EXAMPLE 3 | PFA RESIN | 200 | 150 | ACCEPTABLE | ACCEPTABLE | ACCEPTABLE |
| EXAMPLE 4 | PFA RESIN | 150 | 200 | ACCEPTABLE | ACCEPTABLE | ACCEPTABLE |
| EXAMPLE 5 | PFA RESIN | 150 | 150 | GOOD | GOOD | GOOD |
| EXAMPLE 6 | PFA RESIN | 100 | 100 | GOOD | GOOD | GOOD |
| EXAMPLE 7 | PFA RESIN | 40 | 40 | GOOD | GOOD | GOOD |
| EXAMPLE 8 | COATING FILM OF DEVELOPMENT ROLLER PFA RESIN COATING FILM OF HOLDING ROLLER PI RESIN | 300 | 40 | ACCEPTABLE | ACCEPTABLE | ACCEPTABLE |
| EXAMPLE 9 | COATING FILM OF DEVELOPMENT ROLLER PFA RESIN COATING FILM OF HOLDING ROLLER PI RESIN | 40 | 300 | ACCEPTABLE | ACCEPTABLE | ACCEPTABLE |
| COMPARATIVE EXAMPLE | PI RESIN | 40 | 40 | UNACCEPTABLE | UNACCEPTABLE | UNACCEPTABLE |

FIG. 9

| | SETTING ANGLE θ1 [DEGREE] | FILTERED MAXIMUM WAVINESS [μm] | CLEANING PERFORMANCE EVALUATION |
|---|---|---|---|
| EXAMPLE 10 | 25 | 3.0 | UNACCEPTABLE |
| EXAMPLE 11 | 30 | 3.0 | UNACCEPTABLE |
| EXAMPLE 12 | 35 | 3.0 | GOOD |
| EXAMPLE 13 | 40 | 3.0 | GOOD |
| EXAMPLE 14 | 45 | 3.0 | GOOD |
| EXAMPLE 15 | 25 | 2.5 | UNACCEPTABLE |
| EXAMPLE 16 | 25 | 2.0 | GOOD |
| EXAMPLE 17 | 25 | 1.0 | GOOD |

IMAGE FORMING APPARATUS

CROSS-REFERENCE TO RELATED APPLICATIONS

This application is based on and claims priority under 35 USC 119 from Japanese Patent Application No. 2018-053955 filed Mar. 22, 2018.

BACKGROUND

(i) Technical Field

The present disclosure relates to an image forming apparatus.

(ii) Related Art

A development roller described in Japanese Unexamined Patent Application Publication No. 10-123838 has a cylindrical permanent magnet having, on a surface thereof, magnetic poles of opposite polarities that are disposed in a circumferential direction at regular intervals and a coating layer that is made of a heat-shrinkable resin tube provided on the surface of the permanent magnet.

SUMMARY

In a conventional image forming apparatus using a liquid developer, a cylindrical member having a polyimide coating film is typically used as a cylindrical member that receives the liquid developer and as a cylindrical member on which an image to be transferred onto a recording medium is formed. However, polyimide has a high bending elastic modulus, and therefore sometimes the coating film of the cylindrical member is not deformed along a surface of an object which makes contact with the cylindrical member.

Accordingly, the cylindrical member that receives the liquid developer cannot sufficiently receive the liquid developer, and the cylindrical member on which an image to be transferred is formed fails to transfer part of the image onto a recording medium.

Aspects of non-limiting embodiments of the present disclosure relate to an image forming apparatus that uses a liquid developer that makes an output image less deteriorated than a case where a cylindrical member having a polyimide coating film is used as a cylindrical member that receives the liquid developer or as a cylindrical member on which an image to be transferred onto a recording medium is formed.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including a draw-up member that draws a liquid developer containing oil and toner up from a storage part in which the liquid developer is stored while rotating; a cylindrical member that is disposed so as to face the draw-up member, receives the liquid developer from the draw-up member while rotating, and has a circumferential surface on which a film of the liquid developer is formed, the cylindrical member having an elastic part having a circular cross section and a coating film that covers the elastic part and is made of a copolymer of tetrafluoroethylene and perfluoroalkyl vinyl ether; and a formation member having a circumferential surface on which an image is formed by the liquid developer received by the cylindrical member.

BRIEF DESCRIPTION OF THE DRAWINGS

An exemplary embodiment of the present disclosure will be described in detail based on the following figures, wherein:

FIG. 8 illustrates a table showing results of evaluations of Examples of the image forming apparatus according to the exemplary embodiment of the present disclosure and a comparative example;

FIG. 9 illustrates a table showing results of evaluations of Examples of the image forming apparatus according to the exemplary embodiment of the present disclosure;

DETAILED DESCRIPTION

Figure 1:
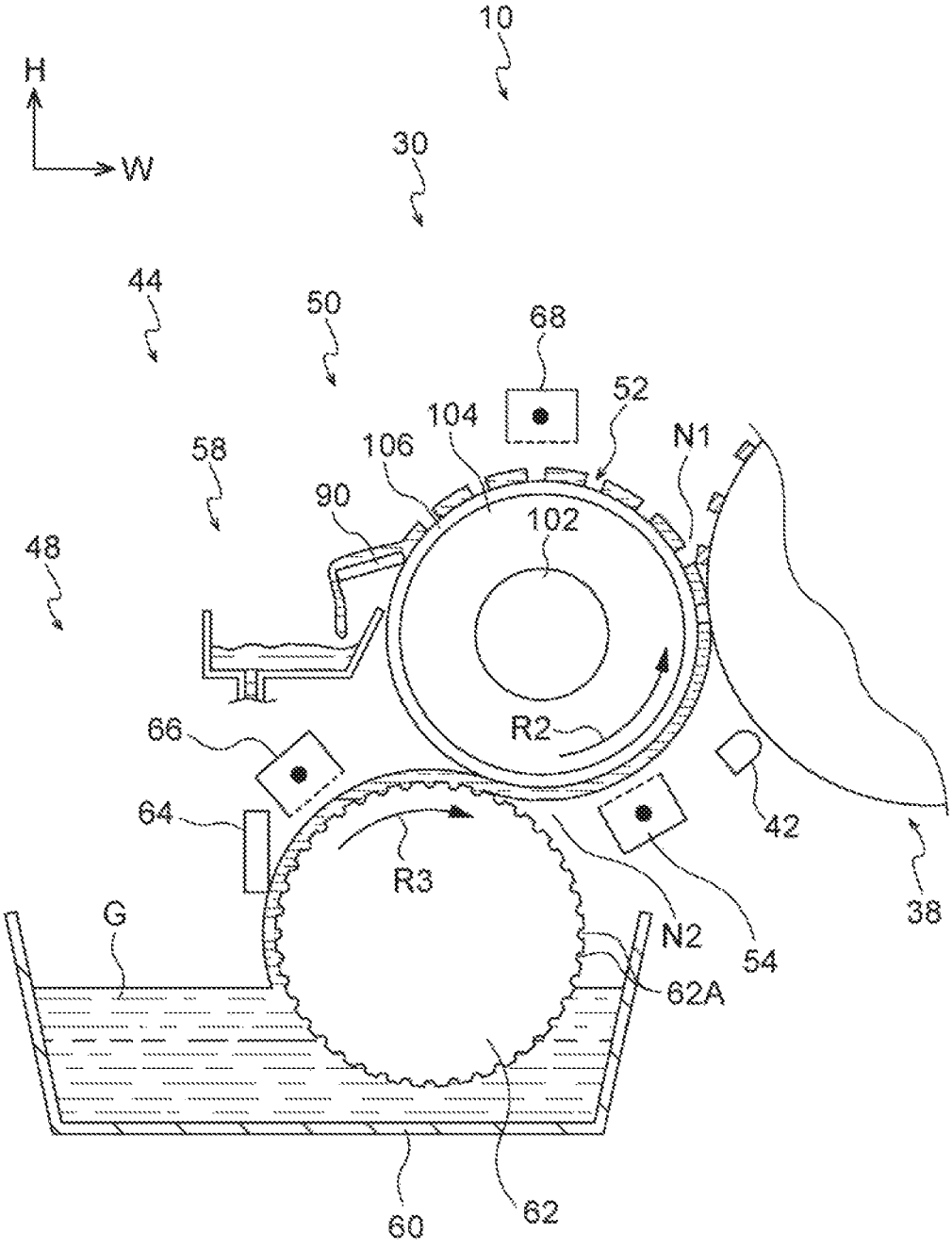
FIG. 1 is a configuration diagram illustrating a developing device provided in an image forming apparatus according to an exemplary embodiment of the present disclosure.

An example of an image forming apparatus according to an exemplary embodiment of the disclosure is described with reference to FIGS. 1 through 13. In the drawings, the arrow H indicates a device height direction (vertical direction), the arrow W indicates a device width direction (horizontal direction), and the arrow D indicates a device depth direction (horizontal direction).

Overall Configuration

Figure 5:
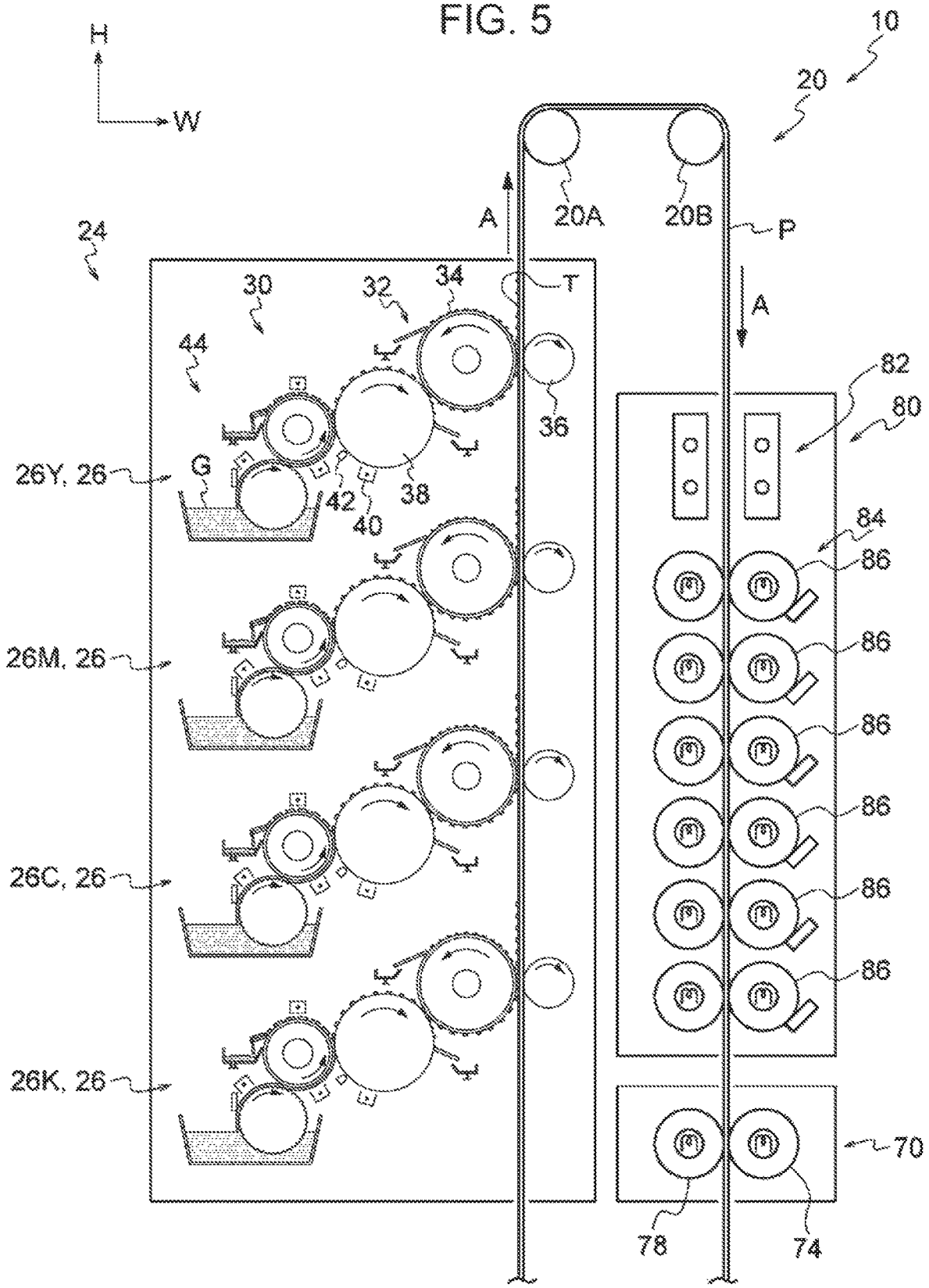
FIG. 5 is a configuration diagram schematically illustrating the image forming apparatus according to the exemplary embodiment of the present disclosure.

An image forming apparatus 10 is an apparatus that forms a toner image T on continuous paper P that is a long recording medium by using a liquid-type liquid developer G obtained by dispersing powder toner into volatile oil (carrier liquid). As illustrated in FIG. 5, the image forming apparatus 10 includes a transporting part 20 that transports the continuous paper P and an image processing part 24 that forms the toner image T.

Furthermore, the image forming apparatus 10 includes an oil removing part 80 that removes oil from the continuous paper P and a fixing device 70 that fixes the toner image T onto the continuous paper P.

In the present exemplary embodiment, for example, Isopar L (boiling point 184° C.) produced by Exxon Mobil Corporation is used as the oil.

Transporting Part 20

The transporting part 20 is configured to transport the continuous paper P in a direction (hereinafter referred to as a "medium transporting direction") indicated by the arrow A in FIG. 5 at a predetermined constant transport speed and includes a pair of transporting rollers 20A and 20B.

Image Processing Part 24

The image processing part 24 includes an image forming part 26Y that forms a yellow (Y) toner image T, an image forming part 26M that forms a magenta (M) toner image T, an image forming part 26C that forms a cyan (C) toner image T, and an image forming part 26K that forms a black (K) toner image T. The image forming part 26K, the image forming part 26C, the image forming part 26M, and the image forming part 26Y are aligned in this order in the device height direction from an upstream side in the medium transporting direction.

Hereinafter, "Y", "M", "C", and "K" at the end of the signs are omitted in a case where these parts need not be distinguished from one another.

Figure 3:
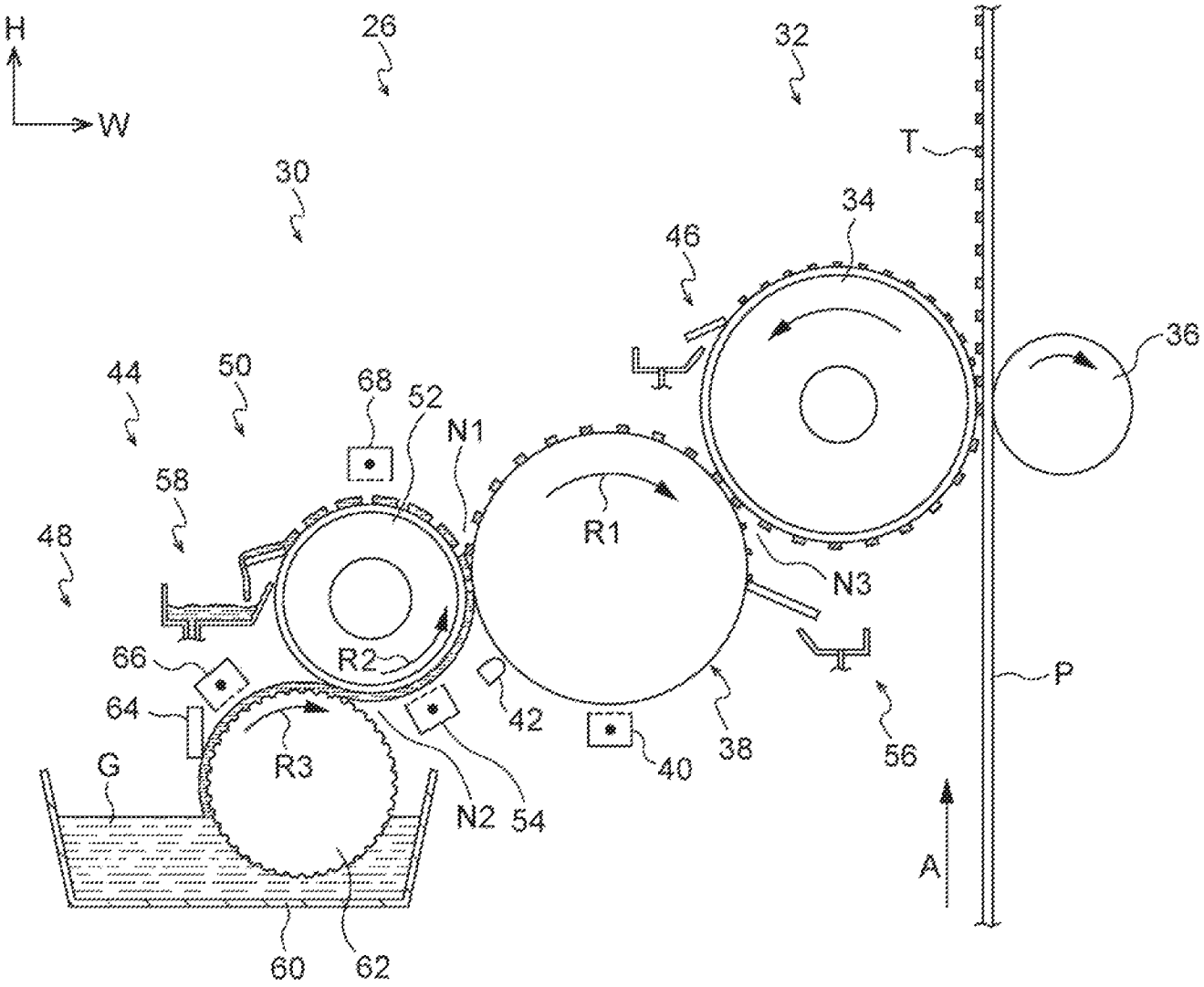
FIG. 3 is a configuration diagram illustrating an image forming part provided in the image forming apparatus according to the exemplary embodiment of the present disclosure.

As illustrated in FIG. 3, each of the image forming parts 26 includes an image forming unit 30 that forms a toner image T by using the liquid developer G and a transfer unit 32 that transfers the toner image T formed by the image forming unit 30 onto continuous paper P. The liquid developer G used in the present exemplary embodiment is a liquid-type liquid developer G obtained by dispersing powder toner into volatile oil as described above. The "volatile" in the present exemplary embodiment means that a volatile portion of a substance is larger than 8% by weight after the substance is left in a 25° C. open system for 24 hours in a state where a flash point is less than 130° C. or is 150° C. The flash point is measured according to JIS K2265-4 (2007).

Image Forming Unit 30

The image forming unit 30 includes a photoconductor 38 having a circumferential surface on which a toner image T is formed, a charging member 40 that charges the photoconductor 38, an exposure device 42 that forms an electrostatic latent image by irradiating the photoconductor 38 with exposure light, and a developing device 44 that develops the electrostatic latent image on the photoconductor 38 as a toner image T. Furthermore, the image forming unit 30 includes a collecting device 56 that collects the liquid developer G remaining on the photoconductor 38 from the photoconductor 38. The photoconductor 38 is an example of a formation member.

Developing Device 44

As illustrated in FIG. 1, the developing device 44 includes a developing part 50 that delivers the liquid developer G to an electrostatic latent image formed on the photoconductor 38 and a supplying part 48 that supplies the liquid developer G to the developing part 50.

The developing part 50 includes a development roller 52 that rotates (revolves) around an axis (in a direction indicated by the arrow R2) and a charging member 54 that is disposed so as to be opposed to the development roller 52. Furthermore, the developing part 50 includes a charging member 68 that charges toner contained in the liquid developer G remaining on the development roller 52 without being supplied to the photoconductor 38 and a collecting device 58 that collects the liquid developer G remaining on the development roller 52.

A developing voltage is applied to the development roller 52 by a power source (not illustrated), and an electric field for developing an electrostatic latent image formed on the photoconductor 38 is formed between the development roller 52 and the photoconductor 38 (in a nip part N1). Furthermore, an electric field for supplying the liquid developer G from a draw-up roller 62 to the development roller 52 is formed between the development roller 52 and the draw-up roller 62 that will be described later (in a nip part N2).

The charging member 54 is used to charge toner contained in the liquid developer G, for example, to a positive polarity. The charging member 54 is disposed so as to be opposed to the development roller 52 on a downstream side relative to the nip part N2 and an upstream side relative to the nip part N1 in a direction of rotation of the development roller 52. The charging member 68 is used to charge toner contained in the liquid developer G remaining on the development roller 52, for example, to a negative polarity. The charging member 68 is disposed so as to be opposed to the development roller 52 on a downstream side relative to the nip part N1 and an upstream side relative to the collecting device 58 in the direction of rotation of the development roller 52.

In this configuration, the charging member 54 changes toner contained in the liquid developer G supplied to the development roller 52 and held by the development roller 52, and the liquid developer G containing the toner is delivered from the development roller 52 to an electrostatic latent image formed on the photoconductor 38. In a case where the electrostatic latent image is developed as a toner image T by using the liquid developer G, oil also transfers to the photoconductor 38. Furthermore, the charging member 68 changes toner contained in the liquid developer G remaining on the development roller 52 to a negative polarity. Charging the toner to a negative polarity makes it easier to collect the liquid developer G from the development roller 52. Then, the collecting device 58 collects the liquid developer G remaining on the development roller 52.

The supplying part 48 includes a storage part 60 in which the liquid developer G is stored and the draw-up roller 62 (an anilox roller) that draws the liquid developer G up from the storage part 60 and supplies the liquid developer G to the development roller 52. Furthermore, the supplying part 48 includes a blade 64 that adjusts a layer film of the liquid developer G held by the draw-up roller 62 and a charging member 66 that charges toner contained in the liquid developer G held by the draw-up roller 62, for example, to a positive polarity. Details of the development roller 52, the draw-up roller 62, and the collecting device 58 will be described later.

Transfer Unit 32

Figure 2:
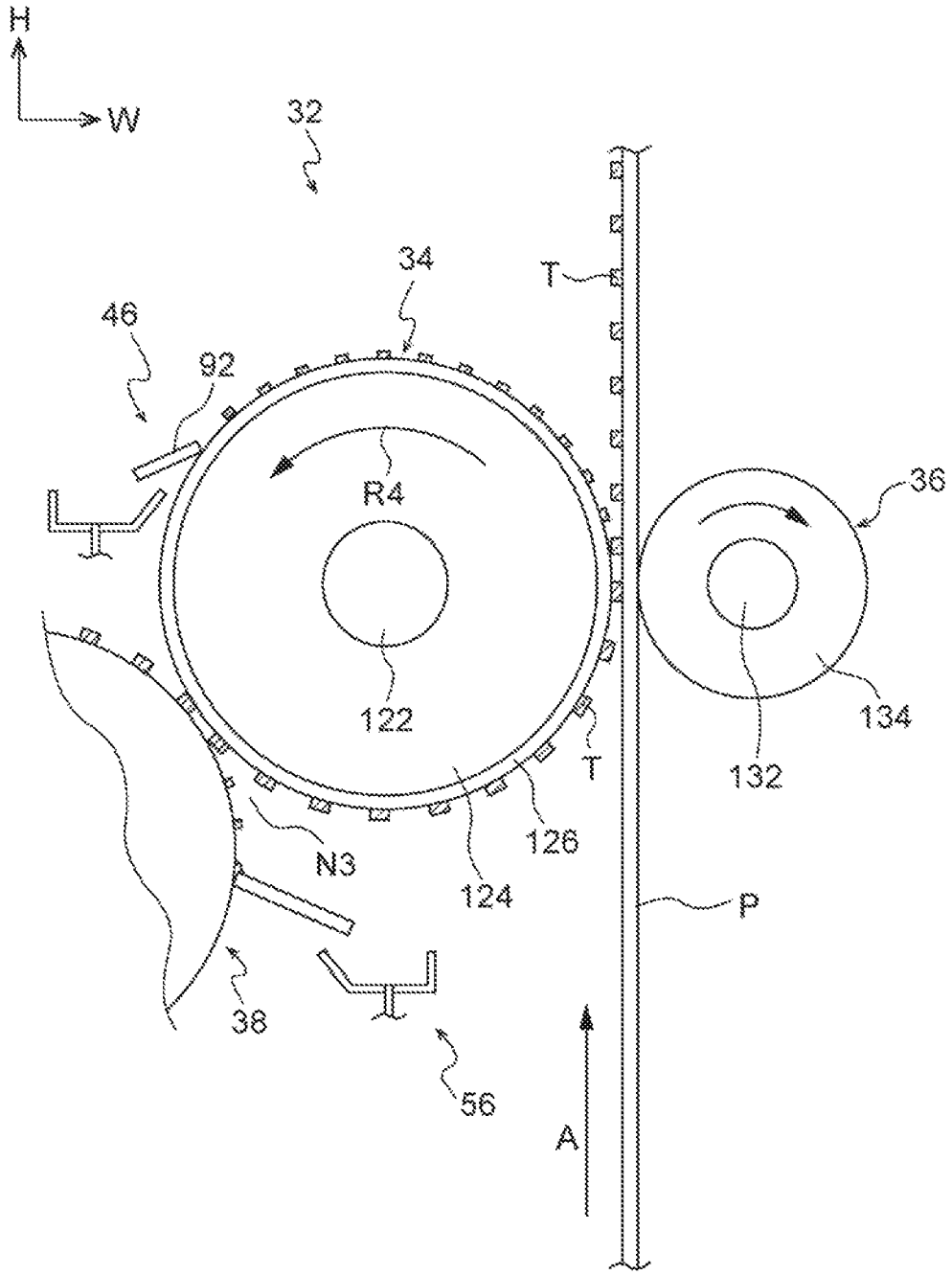
FIG. 2 is a configuration diagram illustrating a transfer unit provided in the image forming apparatus according to the exemplary embodiment of the present disclosure.

As illustrated in FIG. 2, the transfer unit 32 includes a holding roller 34 on which a toner image T held by the photoconductor 38 is transferred and is held. Furthermore, the transfer unit 32 includes a transfer roller 36 that is disposed on a side opposite to the holding roller 34 across the continuous paper P and a collecting device 46 that collects the liquid developer G remaining on the holding roller 34. Details of the holding roller 34, the transfer roller 36, and the collecting device 46 will be described later.

In this configuration, a first transfer voltage is applied to the holding roller 34 that rotates in a direction indicated by the arrow R4 in FIG. 2 by a power source (not illustrated). This forms an electric field for transferring the toner image T on the photoconductor 38 onto the holding roller 34 between the holding roller 34 and the photoconductor 38 (in a nip part N3). This electric field causes the toner image T held by the photoconductor 38 to be transferred onto the holding roller 34.

A second transfer voltage is applied to the transfer roller 36 by a power source (not illustrated). This forms, between the transfer roller 36 and the holding roller 34, an electric field for transferring the toner image T on the holding roller 34 onto the continuous paper P. This electric field causes the toner image T transferred onto the holding roller 34 to be transferred onto the continuous paper P. The collecting device 46 collects the liquid developer G remaining on the holding roller 34.

Oil Removing Part 80

As illustrated in FIG. 5, the oil removing part 80 includes a melting part 82 that heats continuous paper P and an oil receiving part 84 that receives oil on the continuous paper P. The oil receiving part 84 includes plural pairs of heating rollers 86 each including a heater.

In this configuration, the melting part 82 heats the continuous paper P. The pairs of heating rollers 86 transport the continuous paper P while sandwiching the continuous paper P, and thus the heating rollers 86 that make contact with an image formation surface of the continuous paper P receive oil from the continuous paper P.

Fixing Device 70

The fixing device 70 includes a fixing roller 74 that includes a heater and a sandwiching roller 78 that is disposed on a side opposite to the fixing roller 74 across the continuous paper P and includes a heater.

In this configuration, the fixing roller 74 heated by the heater and the sandwiching roller 78 heated by the heater transport the continuous paper P while sandwiching the continuous paper P, and thus a toner image T is fixed onto the continuous paper P.

Operation of Overall Configuration

In the image forming apparatus 10, the continuous paper P supplied from a supplying device (not illustrated) is transported along a transport path 28.

Furthermore, as illustrated in FIG. 5, the photoconductor 38 of each of the image forming units 30 of the respective colors rotates, and the photoconductor 38 is charged by the charging member 40. Next, the exposure device 42 exposes the charged photoconductor 38 to light in accordance with image data, and thus an electrostatic latent image is formed on the photoconductor 38. Then, the developing device 44 visualizes the electrostatic latent image as a toner image T by developing the electrostatic latent image.

The toner image T formed on the rotating photoconductor 38 is first-transferred onto the holding roller 34. The transfer roller 36 transfers, onto the transported continuous paper P, the toner image T that has been first-transferred onto the holding roller 34. In this process, oil transfers to the continuous paper P together with the toner image T. This process is performed in each of the image forming parts 26 of the respective colors, and thus toner images T of the respective colors are transferred onto the continuous paper P.

Furthermore, the oil removing part 80 removes oil that has transferred onto the continuous paper P from the continuous paper P when the toner image T is transferred onto the continuous paper P. Furthermore, the fixing device 70 fixes the toner image T transferred onto the transported continuous paper P.

Configuration of Substantial Parts

Development Roller 52, Draw-Up Roller 62, and Collecting Device 58

Next, a development roller 52, a draw-up roller 62, and a collecting device 58 are described.

Development Roller 52

As illustrated in FIG. 1, the development roller 52 has an axial part 102 that forms a rotary axis and is made of a metal material, a cylindrical elastic part 104 which the axial part 102 penetrates, and a coating film 106 that coats the elastic part 104. The development roller 52 is an example of a cylindrical member. In the present exemplary embodiment, an external diameter of the development roller 52 is 165 mm.

The elastic part 104 is made of a rubber material that is an elastic material containing an electrical conducting material. In the present exemplary embodiment, a hardness of the elastic part 104 is not less than 45 Hs and not more than 55 Hs according to JIS A hardness (JIS K 6253 type A). That is, the elastic part 104 is a member that is made of a material that is not less than 45 Hs and not more than 55 Hs according to JIS A hardness. Considering output image evaluations that will be described later, the hardness of the elastic part 104 is desirably not less than 48 Hs and not more than 52 Hs, more desirably 50 Hs according to JIS A hardness.

The coating film 106 is made of a copolymer (hereinafter referred to as a "PFA resin") of tetrafluoroethylene and perfluoroalkyl vinyl ether that contains an electrical conducting material. A bending elastic modulus of the coating film 106 is set to not less than 0.4 GPa and not more than 0.7 GPa. Considering the output image evaluations that will be described later, the bending elastic modulus of the coating film 106 is desirably not less than 0.4 GPa and not more than 0.6 GPa, more desirably 0.4 GPa and not more than 0.5 GPa. The bending elastic modulus of the coating film 106 can be measured by peeling part of the coating film 106 off from the development roller 52 and evaluating this part according to JIS K 7171 or ISO0178.

A thickness of the coating film 106 is set to not less than 40 μm and not more than 150 μm. Considering the output image evaluations that will be described later, the thickness of the coating film 106 is more desirably not less than 40 μm and not more than 100 μm.

Draw-Up Roller 62

The draw-up roller 62 is made of a metal material, and grooves 62A that extend in an axial direction are provided side by side in a circumferential direction on a circumferential surface of the draw-up roller 62. That is, the circumferential surface of the draw-up roller 62 is a corrugated surface. The draw-up roller 62 is an example of a draw-up member. In the present exemplary embodiment, the draw-up roller 62 is pressed against the development roller 52 at a pressure of not less than 19.6 kPa and not more than 196 kPa. Furthermore, an external diameter of the draw-up roller 62 is set to 160 mm, and a depth of the grooves 62A is set to 40 μm.

Collecting Device 58

The collecting device 58 includes a removing blade 90 made of polyurethane rubber. That is, the removing blade 90 is made of an elastic material that can be elastically deformed. This removing blade 90 has a plate shape having a rectangular cross section, and an end of the removing blade 90 is in contact with a circumferential surface of the development roller 52. The removing blade 90 is an example of a removing member.

In the present exemplary embodiment, a thickness of the removing blade 90 is set to 2 mm, and force by which the removing blade 90 is pressed against the circumferential surface of the development roller 52 is not less than $9.8\times10^{-3}$ N/mm and not more than $9.8\times10^{-2}$ N/mm. This keeps the liquid developer G remaining on the circumferential surface of the development roller 52 from passing the removing blade 90 and remaining on the circumferential surface of the development roller 52.

In this configuration, the draw-up roller 62 that rotates in a direction indicated by the arrow R3 in FIG. 1 draws up the liquid developer G stored in the storage part 60. Then, the blade 64 adjusts a layer film of the liquid developer G, and the charging member 66 charges toner contained in the liquid developer G. Furthermore, the liquid developer G drawn up by the draw-up roller 62 is supplied to the development roller 52 by an electric field formed between the draw-up roller 62 and the development roller 52. This forms a film (layer) of the liquid developer G on the development roller 52. Toner contained in the liquid developer G formed on the development roller 52 is delivered from the development roller 52 to an electrostatic latent image formed on the photoconductor 38.

Furthermore, the removing blade 90 peels the liquid developer G remaining on the development roller 52 off from the development roller 52, and thus the collecting device 58 collects the liquid developer G remaining on the development roller 52.

Holding Roller 34, Transfer Roller 36, and Collecting Device 46

Next, the holding roller 34, the transfer roller 36, and the collecting device 46 are described.

Holding Roller 34

As illustrated in FIG. 2, the holding roller 34 has an axial part 122 that forms a rotary axis and is made of a metal material, a cylindrical elastic part 124 which the axial part 122 penetrates, and a coating film 126 that coats the elastic part 124. The holding roller 34 is an example of a cylindrical member. In the present exemplary embodiment, an external diameter of the holding roller 34 is set to 242 mm.

The elastic part 124 is made of a rubber material that is an elastic material containing an electrical conducting material. In the present exemplary embodiment, a hardness of the elastic part 124 is set to not less than 45 Hs and not more than 55 Hs according to JIS A hardness. That is, the elastic part 124 is a member made of a material that is not less than 45 Hs and not more than 55 Hs according to JIS A hardness. Considering the output image evaluations that will be described later, the hardness of the elastic part 124 is desirably not less than 48 Hs and not more than 52 Hs, more desirably 50 Hs according to JIS A hardness.

The coating film 126 is made of a PFA resin that contains an electrical conducting material. A bending elastic modulus of the coating film 126 is set to not less than 0.4 GPa and not more than 0.7 GPa. Considering the output image evaluations that will be described later, the bending elastic modulus of the coating film 126 is desirably not less than 0.4 GPa and not more than 0.6 GPa, more desirably not less than 0.4 GPa and not more than 0.5 GPa. The bending elastic modulus of the coating film 126 can be measured by peeling part of the coating film 126 off from the holding roller 34 and evaluating this part according to JIS K 7171 or ISO0178.

A thickness of the coating film 126 is set to not less than 40 μm and not more than 150 μm. Considering the output image evaluations that will be described later, the thickness of the coating film 126 is more desirably not less than 40 μm and not more than 100 μm.

Transfer Roller 36

The transfer roller 36 has an axial part 132 that forms a rotary axis and is made of a metal material and a cylindrical elastic part 134 which the axial part 132 penetrates. The transfer roller 36 makes contact with the transported continuous paper P and rotates so as to follow the transported continuous paper P. The transfer roller 36 is an example of a transfer member.

The elastic part 134 is made of a rubber material that is an elastic material containing an electrical conducting material. In the present exemplary embodiment, a hardness of the elastic part 134 is set to not less than 45 Hs and not more than 55 Hs according to JIS A hardness. Considering the output image evaluations that will be described later, the hardness of the elastic part 134 is desirably 50 Hs according to JIS A hardness.

In the present exemplary embodiment, an external diameter of the transfer roller 36 is set to 200 mm, and the transfer roller 36 is pressed against the holding roller 34 with the continuous paper P interposed therebetween at a pressure of not less than 98.0 kPa and not more than 392 kPa.

Collecting Device 46

The collecting device 46 includes a removing blade 92 that is made of polyurethane rubber. That is, the removing blade 92 is made of an elastic material that can be elastically deformed. The removing blade 92 has a plate shape, and an end of the removing blade 92 is in contact with a circumferential surface of the holding roller 34. In the present exemplary embodiment, a thickness of the removing blade 92 is set to 2 mm, and force by which the removing blade 92 is pressed against the circumferential surface of the holding roller 34 is set to not less than $9.8\times10^{-3}$ N/mm and not more than $9.8\times10^{-2}$ N/mm. This keeps the liquid developer G remaining on the circumferential surface of the holding roller 34 from passing the removing blade 92 and remaining on the circumferential surface of the holding roller 34.

In this configuration, the transfer roller 36 and the holding roller 34 sandwich the continuous paper P, and thus the continuous paper P is pressed against the holding roller 34. A second transfer voltage is applied to the transfer roller 36 by a power source (not illustrated). This forms, between the transfer roller 36 and the holding roller 34, an electric field for transferring a toner image T on the holding roller 34 onto the continuous paper P. This electric field transfers, onto the continuous paper P, the toner image T transferred onto the holding roller 34.

The removing blade 92 peels the liquid developer G remaining on the holding roller 34 off from the holding roller 34, and thus the collecting device 46 collects the liquid developer G remaining on the holding roller 34.

Operation

Next, operation of a substantial part of the image forming apparatus 10 is described. The following describes the operation of the substantial part of the image forming apparatus 10 in comparison with an image forming apparatus 510 according to a comparative embodiment. First, differences of a configuration of the image forming apparatus 510 from the image forming apparatus 10 according to the present exemplary embodiment are described below.

Image Forming Apparatus 510

Figure 12:
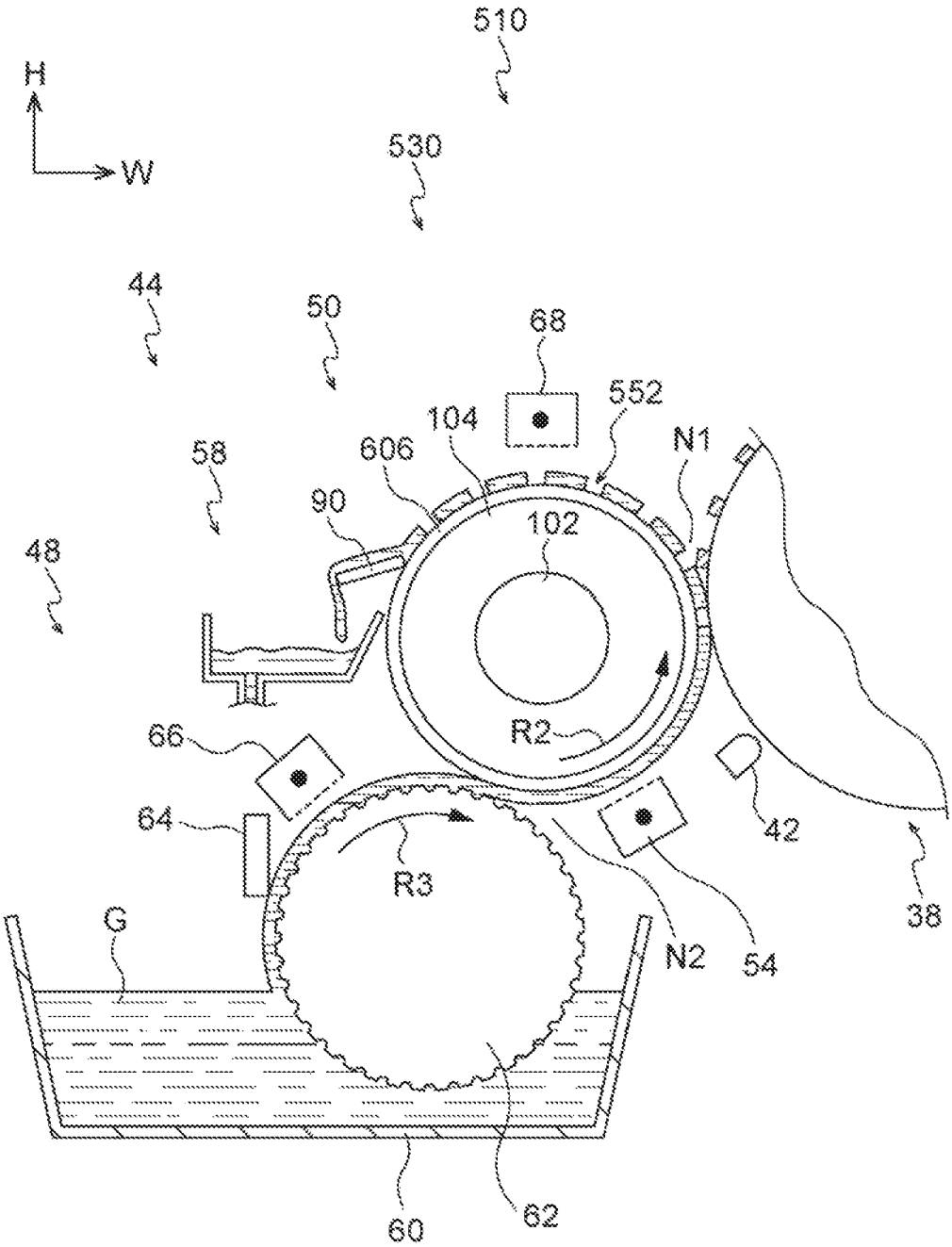
FIG. 12 is a configuration diagram illustrating a developing device provided in the image forming apparatus according to the comparative embodiment of the present disclosure.

As illustrated in FIG. 12, a development roller 552 provided in an image forming unit 530 of the image forming apparatus 510 has an axial part 102, a cylindrical elastic part 104 which the axial part 102 penetrates, and a coating film 606 that coats the elastic part 104.

The coating film 606 is made of polyimide (hereinafter referred to as a "PI resin") containing an electrical conducting material. A bending elastic modulus of the coating film 606 is set to 2 GPa, and a thickness of the coating film 606 is set to 40 μm. That is, the bending elastic modulus of the coating film 606 is higher than the bending elastic modulus of the coating film 106. This means that the coating film 606 has a higher Shore hardness than the coating film 106.

Figure 13:
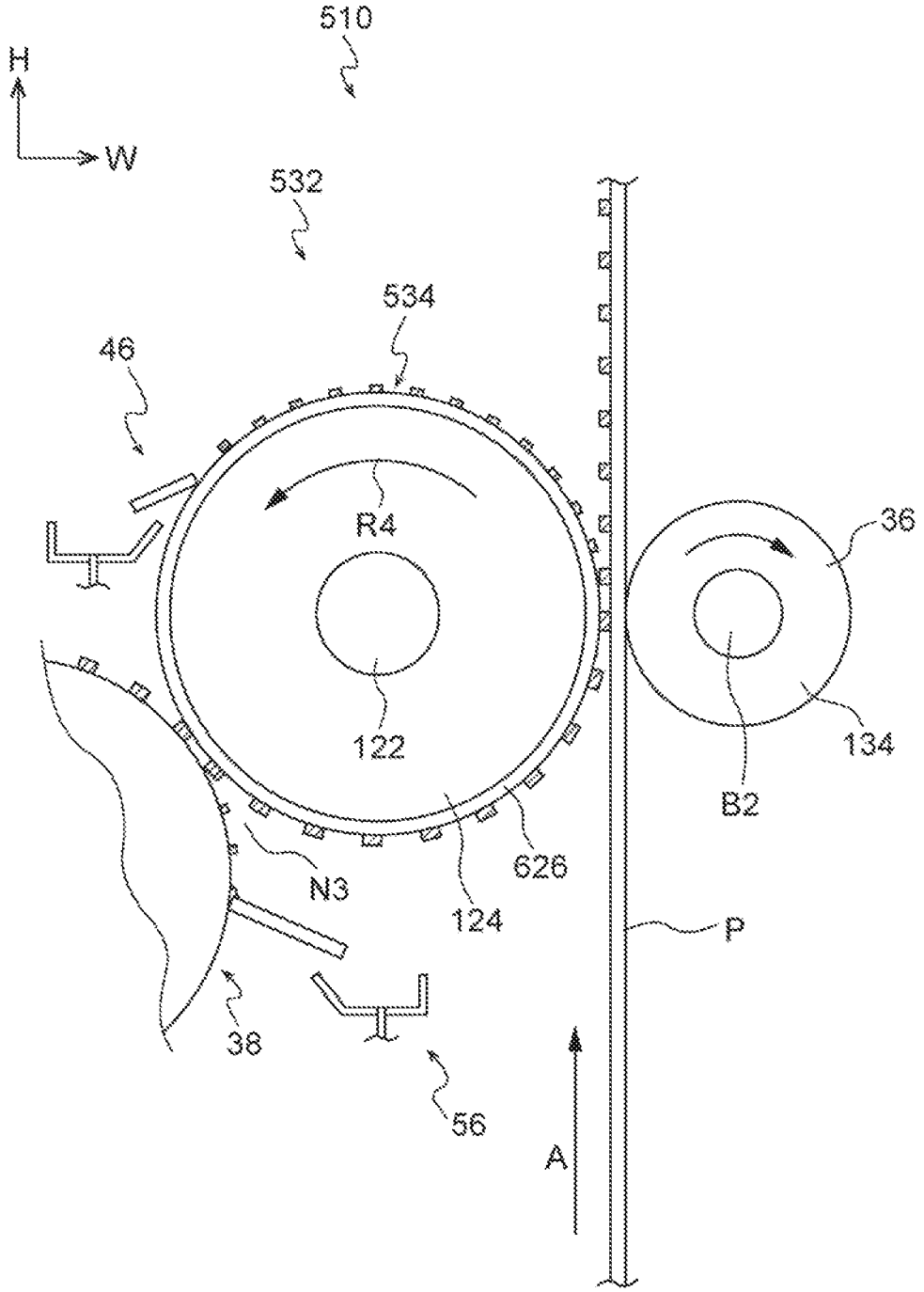
FIG. 13 is a configuration diagram illustrating a transfer unit provided in the image forming apparatus according to the comparative embodiment of the present disclosure.

As illustrated in FIG. 13, a holding roller 534 provided in a transfer unit 532 of the image forming apparatus 510 has an axial part 122, a cylindrical elastic part 124 which the axial part 122 penetrates, and a coating film 626 that covers the elastic part 124.

The coating film 626 is made of polyimide (hereinafter referred to as a "PI resin") containing an electrical conducting material. A bending elastic modulus of the coating film 606 is set to 2 GPa, and a thickness of the coating film 606 is set to 40 μm. That is, the bending elastic modulus of the coating film 626 is higher than the bending elastic modulus of the coating film 126. This means that the coating film 626 is harder to deform than the coating film 126.

Evaluation-1

Next, output image evaluations conducted on the image forming apparatus 10 and the image forming apparatus 510 are described. Specifically, a solid image evaluation, a missing dot evaluation, and an image unevenness evaluation are conducted as the output image evaluations. The evaluations are conducted by using an image forming apparatus obtained by modifying a development roller and a holding roller of MDP1260 manufactured by Miyakoshi Printing Machinery, Co., Ltd.

A rubber member having a hardness of 55 Hs according to JIS A hardness is used as the elastic parts 104 of the development rollers 52 and 552, and a coating film having an elastic modulus of 0.7 GPa is used as the coating film 106 of the development roller 52. The evaluations are conducted while changing the thickness of the coating film 106.

A rubber member having a hardness of 55 Hs according to JIS A hardness is used as the elastic parts 124 of the holding rollers 34 and 534, and a coating film having an elastic modulus of 0.7 GPa is used as the coating film 126 of the holding roller 34. The evaluations are conducted while changing the thickness of the coating film 126.

OK topcoat ±127.9 manufactured by OJI PAPER CO., LTD. is used as the continuous paper P. A surface of this continuous paper P has an allowable level of unevenness as the continuous paper P.

Evaluation Specifications

In Example 1, the development roller 52 having the coating film 106 having a thickness of 300 μm and the holding roller 34 having the coating film 126 having a thickness of 300 μm are used (see FIG. 8).

In Example 2, the development roller 52 having the coating film 106 having a thickness of 200 μm and the holding roller 34 having the coating film 126 having a thickness of 200 μm are used.

In Example 3, the development roller 52 having the coating film 106 having a thickness of 200 μm and the holding roller 34 having the coating film 126 having a thickness of 150 μm are used.

In Example 4, the development roller 52 having the coating film 106 having a thickness of 150 μm and the holding roller 34 having the coating film 126 having a thickness of 200 μm are used.

In Example 5, the development roller 52 having the coating film 106 having a thickness of 150 μm and the holding roller 34 having the coating film 126 having a thickness of 150 μm are used.

In Example 6, the development roller 52 having the coating film 106 having a thickness of 100 μm and the holding roller 34 having the coating film 126 having a thickness of 100 μm are used.

In Example 7, the development roller 52 having the coating film 106 having a thickness of 40 μm and the holding roller 34 having the coating film 126 having a thickness of 40 μm are used.

In Example 8, the development roller 52 having the coating film 106 having a thickness of 300 μm and the holding roller 34 having a coating film made of a PI resin and having a thickness of 40 μm are used.

In Example 9, a development roller having a coating film made of a PI resin and having a thickness of 40 μm and the holding roller 34 having the coating film 126 having a thickness of 300 μm are used.

In a comparative example, the development roller 552 having the coating film 606 having a thickness of 40 μm and the holding roller 534 having the coating film 626 having a thickness of 40 μm are used.

The examples have similar specifications except for the above specifications.

Solid Image Evaluation

A solid image (area coverage 100%) is formed on the continuous paper P by using cyan (C), and uniformity of the solid image is evaluated by visually checking an output image. A case where there is no missing toner is expressed as "good", a case where there is missing toner in an acceptable level as a product is expressed as "acceptable", and a case where there is missing toner in an unacceptable level as a product is expressed as "unacceptable".

Missing Dot Evaluation

A halftone dot image (area coverage 5%) is formed on the continuous paper P by using cyan (C), and dot missing is evaluated by visually checking an output image. A case where there is no missing dot is expressed as "good", a case where there is a missing dot in an acceptable level as a product is expressed as "acceptable", and a case where there is a missing dot in an unacceptable level as a product is expressed as "unacceptable".

Image Unevenness Evaluation

A halftone image (area coverage 50%) is formed on the continuous paper P by using cyan (C), and image unevenness is evaluated by visually checking an output image. A case where the halftone image is formed without unevenness is expressed as "good", a case where there is image unevenness in an acceptable level as a product is expressed as "acceptable", and a case where there is image unevenness in an unacceptable level as a product is expressed as "unacceptable".

Evaluation Results

As described in the table illustrated in FIG. 8, Examples 5 to 7 are evaluated as "good" in all of the evaluations, and Examples 1 to 4 are evaluated as "acceptable" in all of the evaluations. Meanwhile, the comparative example is evaluated as "unacceptable" in all of the evaluations.

DISCUSSION

Comparison Between Comparative Example and Examples 1 to 7

The comparative example is evaluated as "unacceptable" in the solid image evaluation, missing dot evaluation, and image unevenness evaluation. Meanwhile, Examples 1 to 7 are evaluated as "good" or "acceptable" in the solid image evaluation, missing dot evaluation, and image unevenness evaluation. This difference in evaluation result is discussed below.

In the comparative example, the coating film 606 of the development roller 552 and the coating film 626 of the holding roller 534 are made of a PI resin. The bending elastic modulus of each of the coating films 606 and 626 is 2 GPa. Meanwhile, the coating film 106 of the development roller 52 and the coating film 126 of the holding roller 34 according to Examples 1 to 7 are made of a PFA resin. The bending elastic modulus of each of the coating films 106 and 126 is 0.7 GPa. As described above, the bending elastic modulus of each of the coating films 606 and 626 in the comparative example is set higher than the bending elastic modulus of each of the coating films 106 and 126 in Examples. That is, the coating films 606 and 626 are harder to deform than the coating films 106 and 126 as described earlier.

Figure 10A:
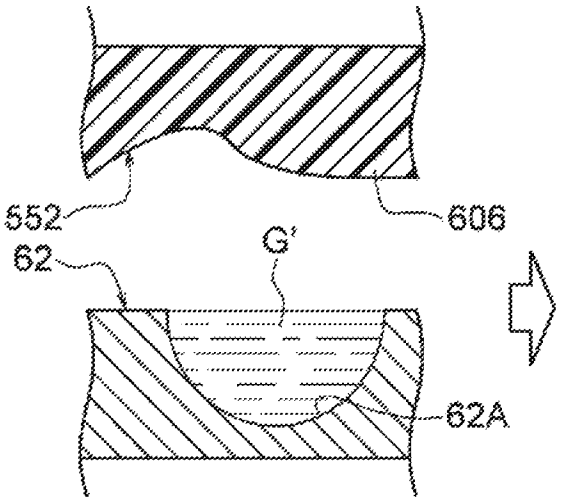
FIGS. 10A, 10B, and 10C are schematic views used to explain a situation in which a liquid developer is supplied from a draw-up roller to a development roller in an image forming apparatus according to a comparative embodiment of the present disclosure.
Figure 10B:
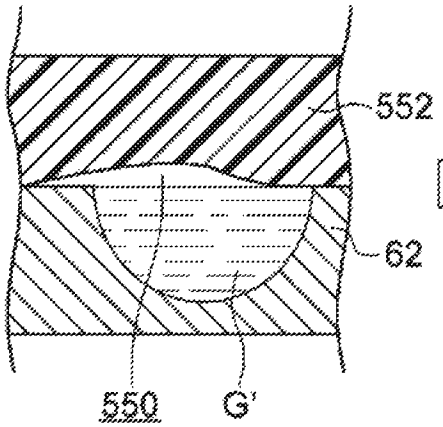
Figure 10C:
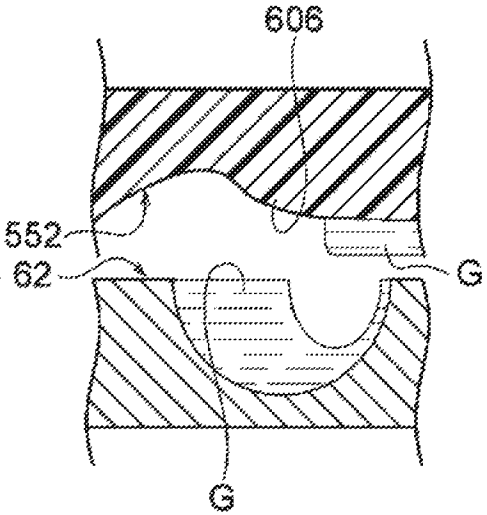

For this reason, the comparative example is considered to fail to sufficiently supply the liquid developer G to the development roller 552 in a state where the liquid developer G has been supplied from the draw-up roller 62 to the development roller 552. Specifically, as illustrated in FIG. 10A, a circumferential surface of the development roller 552 is recessed slightly in some cases. In such cases, as illustrated in FIG. 10B, the coating film 606 is not sufficiently deformed even in a case where the draw-up roller 62 is pressed against the development roller 552, and therefore a gap 550 is created between the development roller 552 and the liquid developer G drawn up by the draw-up roller 62. This is considered to be why the liquid developer G is not sufficiently supplied to the development roller 552 as illustrated in FIG. 10C.

Figure 11A:
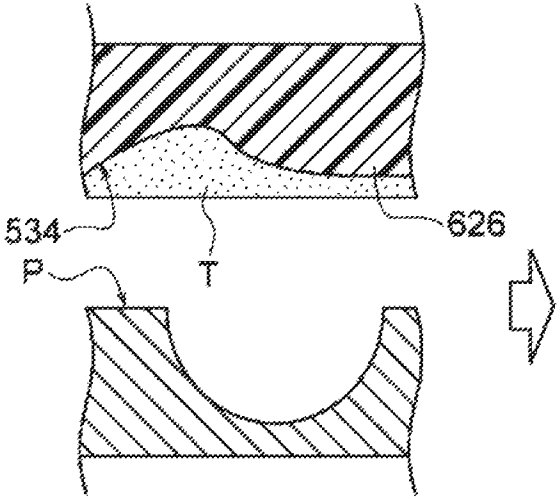
FIGS. 11A, 11B, and 11C are schematic views used to explain a situation in which a toner image is transferred from a holding roller to continuous paper in the image forming apparatus according to the comparative embodiment of the present disclosure.
Figure 11B:
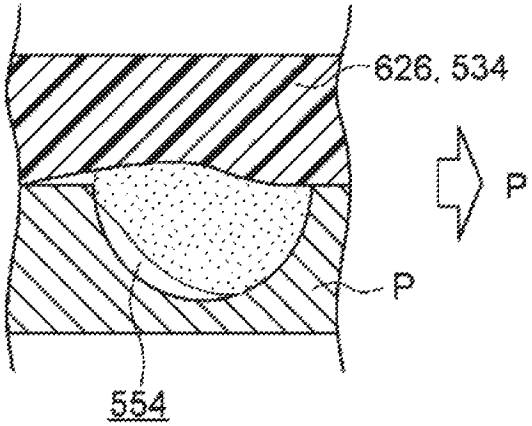
Figure 11C:
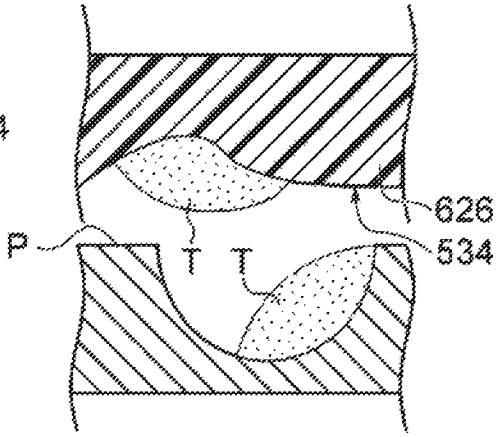

Furthermore, the comparative example is considered to fail to transfer part of the toner image T onto the continuous paper P in a state where the toner image T has been transferred from the holding roller 534 to the continuous paper P. Specifically, a circumferential surface of the holding roller 534 is slightly recessed in some cases as illustrated in FIG. 11A. As described above, the surface of the continuous paper P is uneven. In such a case, as illustrated in FIG. 11B, the coating film 626 is not sufficiently deformed even in a case where the continuous paper P is pressed against the holding roller 534 by the transfer roller 36, and therefore a gap 554 is created between the continuous paper P and the toner image T held by the holding roller 534. This is considered why part of the toner image T is not transferred onto the continuous paper P as illustrated in FIG. 11C.

For the above reasons, the comparative example is considered to be evaluated as "unacceptable" in the output image evaluations.

Figures 6A, 6B, 6C:
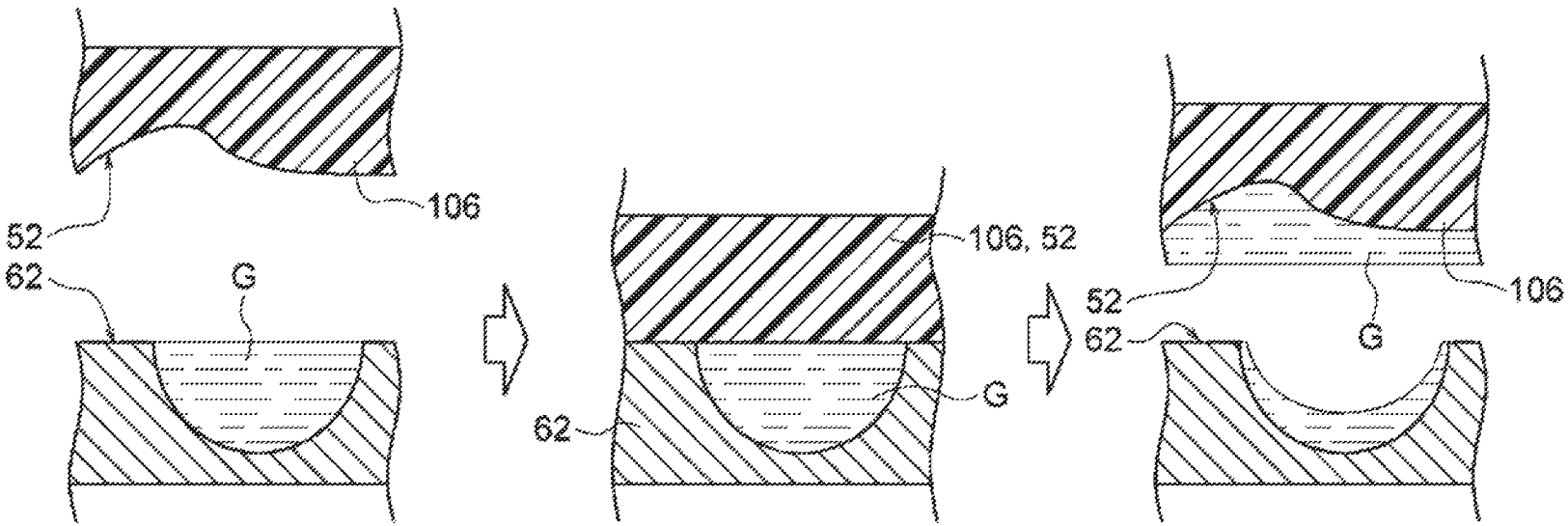
FIGS. 6A, 6B, and 6C are schematic views used to explain a situation in which a liquid developer is supplied from a draw-up roller to a development roller in the image forming apparatus according to the exemplary embodiment of the present disclosure.

Meanwhile, Examples 1 to 7 are considered to allow the liquid developer G to be sufficiently supplied from the draw-up roller 62 to the development roller 52 in a state where the liquid developer G has been supplied from the draw-up roller 62 to the development roller 52. Specifically, the circumferential surface of the development roller 52 is slightly deformed in some cases as illustrated in FIG. 6A. In such cases, as illustrated in FIG. 6B, the coating film 106 is deformed in a case where the draw-up roller 62 is pressed against the development roller 52, and therefore a gap is unlikely to be created between the development roller 52 and the liquid developer G drawn up by the draw-up roller 62. This is considered to be why the liquid developer G is sufficiently supplied to the development roller 52 as illustrated in FIG. 6C.

Figures 7A, 7B, 7C:
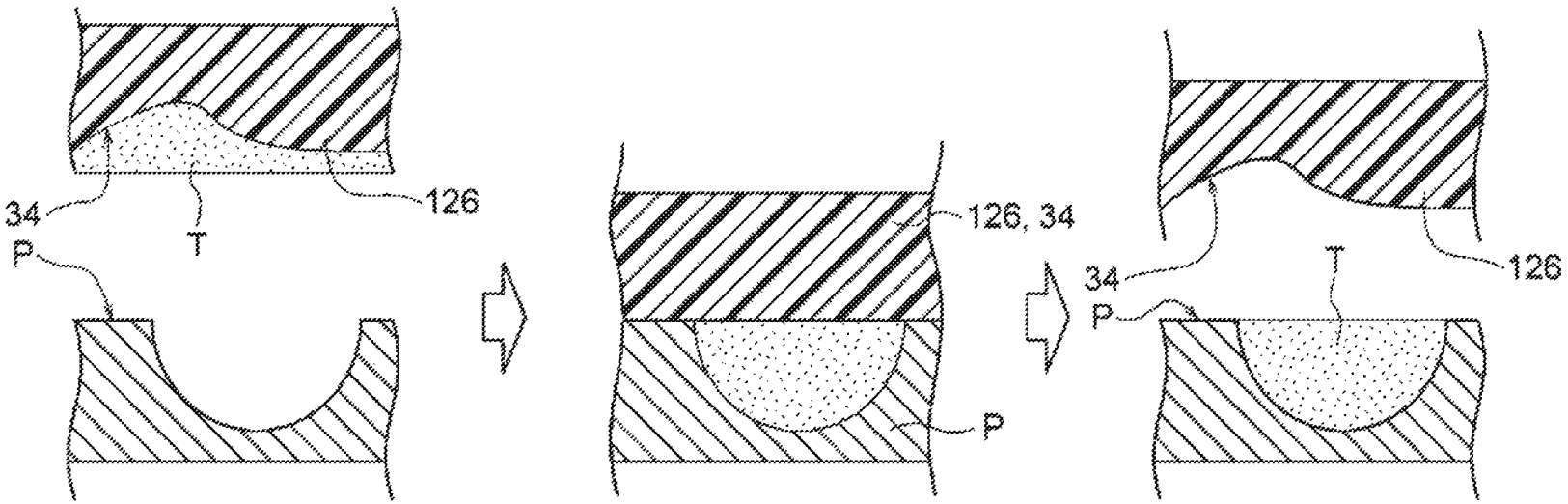
FIGS. 7A, 7B, and 7C are schematic views used to explain a situation in which a toner image is transferred from a holding roller to continuous paper in the image forming apparatus according to the exemplary embodiment of the present disclosure.

Furthermore, Examples 1 to 7 are considered to allow almost whole of the toner image T to be transferred onto the continuous paper P in a state where the toner image T has been transferred from the holding roller 34 to the continuous paper P. Specifically, the circumferential surface of the holding roller 34 is recessed slightly in some cases as illustrated in FIG. 7A. As described above, the surface of the continuous paper P is uneven. In such a case, as illustrated in FIG. 7B, the coating film 126 is deformed in a case where the continuous paper P is pressed against the holding roller 34 by the transfer roller 36, and therefore a gap is unlikely to be created between the continuous paper P and the toner image T held by the holding roller 34. This is why almost whole of the toner image T is transferred onto the continuous paper P as illustrated in FIG. 7C.

For these reasons, Examples 1 to 7 are considered to be evaluated as "acceptable" or "good" in the output image evaluations.

Comparison Between Examples 1 to 4 and Examples 5 to 7

Examples 1 to 4 are evaluated as "acceptable" in the output image evaluations. Meanwhile, Examples 5 to 7 are evaluated as "good" in the output image evaluations. This difference in evaluation result is discussed below.

In Examples 1 to 4, the thickness of at least one of the coating film 106 of the development roller 52 and the coating film 126 of the holding roller 34 is 200 μm or more. Meanwhile, the thickness of the coating film 106 of the development roller 52 and the thickness of the coating film 126 of the holding roller 34 according to Examples 5 to 7 are set to 150 μm or less. That is, the thickness of at least one of the coating film 106 and the coating film 126 according to Examples 1 to 4 is larger than the thickness of the coating films 106 and 126 according to Examples 5 to 7.

Accordingly, in Examples 1 to 4, the circumferential surface of the development roller 52 sometimes does not follow the circumferential surface of the draw-up roller 62 because of the large thickness of the coating film 106 even in a case where the draw-up roller 62 is pressed against the development roller 52. This is considered to prevent the liquid developer G from being sufficiently supplied to the development roller 52.

Furthermore, in Examples 1 to 4, the circumferential surface of the holding roller 34 sometimes does not follow the surface of the continuous paper P because of the large thickness of the coating film 126 even in a case where the continuous paper P is pressed against the holding roller 34 by the transfer roller 36. This is considered to prevent the toner image T from being sufficiently transferred onto the continuous paper P.

For the above reasons, Examples 1 to 4 are considered to be evaluated as "acceptable" in the output image evaluations.

Meanwhile, in Examples 5 to 7, the circumferential surface of the development roller 52 follows the circumferential surface of the draw-up roller 62 because of the small thickness of the coating film 106 in a case where the draw-up roller 62 is pressed against the development roller 52. This is considered to allow the liquid developer G to be sufficiently supplied to the development roller 52.

In Examples 5 to 7, the circumferential surface of the holding roller 34 follows the surface of the continuous paper P because of the small thickness of the coating film 126 in a case where the continuous paper P is pressed against the holding roller 34 by the transfer roller 36. This is considered to allow the toner image T to be sufficiently transferred onto the continuous paper P.

For the above reasons, Examples 5 to 7 are considered to be evaluated as "good" in the output image evaluations.

Note that the thickness of the coating films 106 and 126 in Examples 5 to 7 is set to 40 μm or more in consideration of durability of the coating films 106 and 126. Examples 8 and 9

Examples 8 and 9 are evaluated as "acceptable" in the solid image evaluation, missing dot evaluation, and image unevenness evaluation. This evaluation result is discussed below.

In Examples 1 through 7, the coating film of the development roller and the coating film of the holding roller are made of a PFA resin. This is considered to be why higher output image evaluations are obtained than a case where the coating film of the development roller or the coating film of the holding roller is made of a PI resin.

Evaluation-2

Next, a cleaning performance evaluation conducted on the image forming apparatus 10 is described. Specifically, cleaning performance of cleaning the liquid developer G remaining on the circumferential surface of the development roller 52 is evaluated. The evaluation is conducted by using an image forming apparatus obtained by modifying the development roller 52 and the removing blade 90 of MDP1260 manufactured by Miyakoshi Printing Machinery, Co., Ltd.

A rubber member having a hardness of 55 Hs according to JIS A hardness is used as the elastic part 104 of the development roller 52, and a coating film having an elastic modulus of 0.7 GPa is used as the coating film 106 of the development roller 52. Furthermore, a coating film having a thickness of 300 μm is used as the coating film 106.

Force by which the removing blade 90 is pressed against the development roller 52 is set to $9.8\times10^{-3}$ N/mm.

Figure 4:
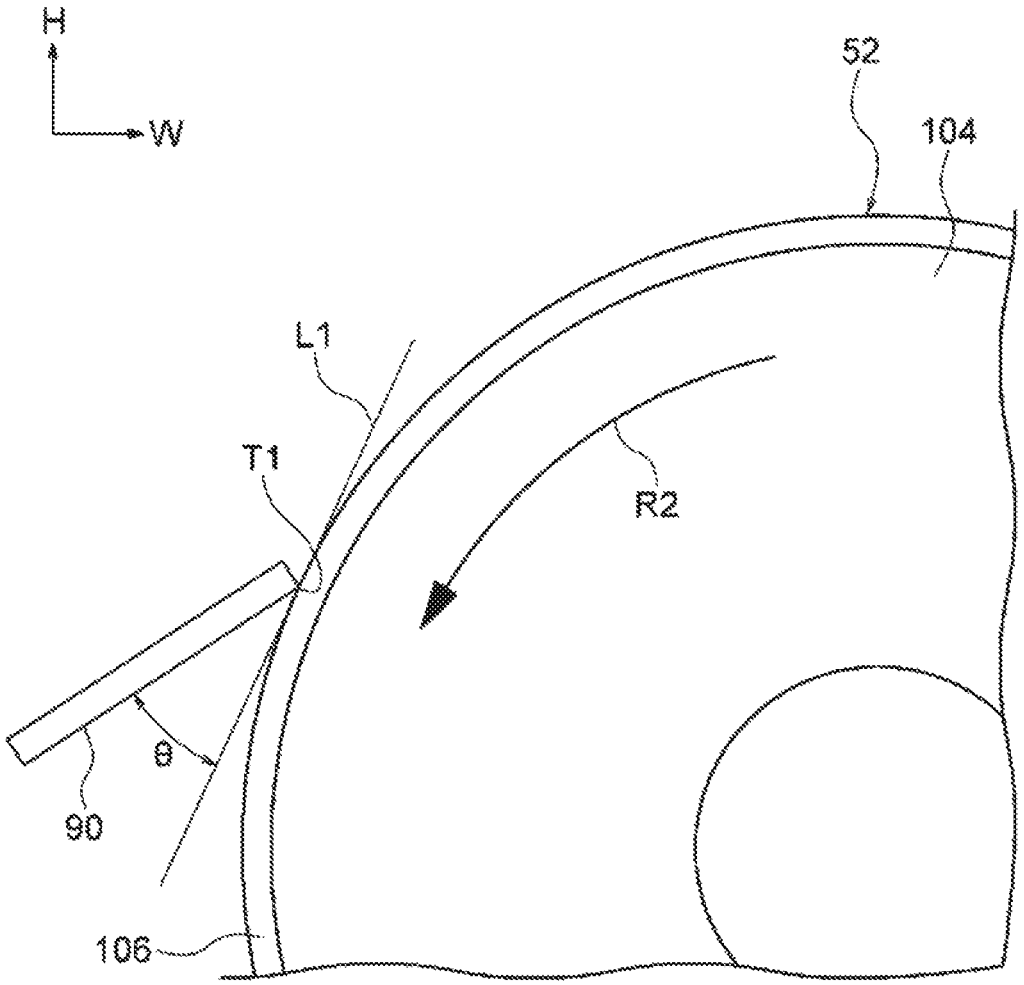
FIG. 4 is a side view illustrating a development roller and a removing blade of the image forming apparatus according to the exemplary embodiment of the present disclosure.

The evaluation is conducted while changing a setting angle θ1 of the removing blade 90 and filtered maximum waviness (JIS B0610) of the circumferential surface of the development roller 52 in an axial direction. As illustrated in FIG. 4, the setting angle θ1 is an angle formed between a tangent L1 to the development roller 52 at a tangent point T1 between the removing blade 90 and the development roller 52 and the removing blade 90.

Evaluation Specifications

In Example 10, the removing blade 90 disposed so that the setting angle θ1 is 25 degrees and the development roller 52 configured such that the filtered maximum waviness (JIS B0610) of the circumferential surface in the axial direction is 3.0 μm are used (see FIG. 9).

In Example 11, the removing blade 90 disposed so that the setting angle θ1 is 30 degrees and the development roller 52 configured such that the filtered maximum waviness of the circumferential surface in the axial direction is 3.0 μm are used.

In Example 12, the removing blade 90 disposed so that the setting angle θ1 is 35 degrees and the development roller 52 configured such that the filtered maximum waviness of the circumferential surface in the axial direction is 3.0 μm are used.

In Example 13, the removing blade 90 disposed so that the setting angle θ1 is 40 degrees and the development roller 52 configured such that the filtered maximum waviness of the circumferential surface in the axial direction is 3.0 μm are used.

In Example 14, the removing blade 90 disposed so that the setting angle θ1 is 45 degrees and the development roller 52 configured such that the filtered maximum waviness of the circumferential surface in the axial direction is 3.0 μm are used.

In Example 15, the removing blade 90 disposed so that the setting angle θ1 is 25 degrees and the development roller 52 configured such that the filtered maximum waviness of the circumferential surface in the axial direction is 2.5 μm are used.

In Example 16, the removing blade 90 disposed so that the setting angle θ1 is 25 degrees and the development roller 52 configured such that the filtered maximum waviness of the circumferential surface in the axial direction is 2.0 μm are used.

In Example 17, the removing blade 90 disposed so that the setting angle θ1 is 25 degrees and the development roller 52 configured such that the filtered maximum waviness of the circumferential surface in the axial direction is 1.0 μm are used.

The examples have similar specifications except for the above specifications.

Cleaning Performance Evaluation

The liquid developer G that has passed the removing blade 90 in a case where a halftone image (area coverage 50%) is formed on the continuous paper P by using cyan (C) is visually checked. In other words, the liquid developer G that has not been removed from the circumferential surface of the development roller 52 by the removing blade 90 is visually checked. A case where the remaining liquid developer G does not pass the removing blade 90 and remain on the circumferential surface of the development roller 52 is expressed as "good", and a case where the liquid developer G passes the removing blade 90 and remains on the circumferential surface of the development roller 52 is expressed as "unacceptable".

Evaluation Results

As for evaluation results, Examples 10, 11, and 15 are evaluated as "unacceptable", as described in the table illustrated in FIG. 9. Meanwhile, Examples 12, 13, 14, 16, and 17 are evaluated as "good".

Discussion

Comparison Between Examples 10 and 11 and Examples 12, 13, and 14

Examples 10 and 11 are considered to cause a front end of the removing blade 90 that is in contact with the development roller 52 to be warped away from the development roller 52 since the setting angle θ1 is smaller than the setting angle θ1 in Examples 12, 13, and 14. Accordingly, the front end of the removing blade 90 is slightly away from the circumferential surface of the development roller 52, and therefore Examples 10 and 11 are considered to be evaluated as "unacceptable" in the cleaning performance evaluation.

Meanwhile, Examples 12, 13, and 14 are considered to keep the front end of the removing blade 90 that is in contact with the development roller 52 from warping away from the development roller 52 since the setting angle θ1 is larger than the setting angle θ1 in Examples 10 and 11. Accordingly, contact between the front end of the removing blade 90 and the circumferential surface of the development roller 52 is maintained although the filtered maximum waviness of the circumferential surface of the development roller 52 is 3.0 μm, and therefore Examples 12, 13, and 14 are considered to be evaluated as "good" in the cleaning performance evaluation.

Comparison Between Examples 10 and 15 and Examples 16 and 17

In Examples 10 and 15, the filtered maximum waviness of the circumferential surface of the development roller 52 is set to 2.5 μm or more. Accordingly, in Examples 10 and 15, the front end of the removing blade 90 is slightly away from the circumferential surface of the development roller 52. This is considered to be why Examples 10 and 15 are evaluated as "unacceptable" in the cleaning performance evaluation.

Meanwhile, in Examples 16 and 17, the filtered maximum waviness of the circumferential surface of the development roller 52 is set to 2.0 μm or less. Accordingly, contact between the front end of the removing blade 90 and the circumferential surface of the development roller 52 is maintained although the setting angle θ1 of the removing blade 90 is 25 degrees. This is considered to be why Examples 16 and 17 are evaluated as "good" in the cleaning performance evaluation.

The cleaning performance evaluation is conducted by using the development roller 52 and the removing blade 90 that removes the liquid developer G remaining on the circumferential surface of the development roller 52. Note, however, that similar evaluation results will be probably obtained even in a case where the holding roller 34 and the removing blade 92 that removes the liquid developer G remaining on the circumferential surface of the holding roller 34 are used.

SUMMARY

As described above, the coating film 106 of the development roller 52 is made of a PFA resin. As is clear from the results of the output image evaluations, an output image is less deteriorated than a case where a development roller having a coating film made of a PI resin is used.

The coating film 126 of the holding roller 34 is made of a PFA resin. As is clear from the results of the output image evaluations, an output image is less deteriorated than a case where a holding roller having a coating film made of a PI resin is used.

As is clear from the results of the output image evaluations, in a case where the bending elastic modulus of the coating film 106 of the development roller 52 is set to 0.7 GPa or less, an output image is less deteriorated than in a case where a coating film having a bending elastic modulus of 2 GPa is used.

As is clear from the results of the output image evaluations, in a case where the bending elastic modulus of the coating film 126 of the holding roller 34 is set to 0.7 GPa or less, an output image is less deteriorated than in a case where a coating film having a bending elastic modulus of 2 GPa is used.

As is clear from the results of the output image evaluations, in a case where the thickness of the coating film 106 of the development roller 52 is set to not less than 40 μm and not more than 150 μm, an output image is less deteriorated than in a case where a coating film having a thickness of larger than 150 μm is used.

As is clear from the results of the output image evaluations, in a case where the thickness of the coating film 126 of the holding roller 34 is set to not less than 40 μm and not more than 150 μm, an output image is less deteriorated than in a case where a coating film having a thickness of larger than 150 μm is used.

As is clear from the results of the cleaning performance evaluation, in a case where the setting angle θ1 of the removing blades 90 and 92 is set to not less than 35 degrees and not more than 45 degrees, cleaning performance of removing the liquid developer G remaining on the circumferential surfaces of the development roller 52 and the holding roller 34 is higher than in a case where the setting angle θ1 of the removing blades 90 and 92 is set to 30 degrees or less.

Furthermore, in a case where the filtered maximum waviness of the circumferential surface of the development roller 52 and the filtered maximum waviness of the circumferential surface of the holding roller 34 are set to 2.0 μm or less, cleaning performance of removing the liquid developer G remaining on the circumferential surfaces of the development roller 52 and the holding roller 34 is higher than in a case where the filtered maximum waviness is 2.5 μm or more.

Although a specific exemplary embodiment of the present disclosure has been described in detail, the present disclosure is not limited to the above exemplary embodiment, and it is clear to a person skilled in the art that other various exemplary embodiments are also encompassed within the scope of the present disclosure.

For example, although the bending elastic modulus of the coating films 106 and 126 is set to 0.7 GPa or less by using a PFA resin in the above exemplary embodiment, a bending elastic modulus of a coating film may be set to 0.7 GPa or less by using a tetrafluoroethylene/hexafluoropropylene copolymer (FEP resin) or polytetrafluoroethylene (PTEE). However, in this case, the effect produced in a case where the coating films 106 and 126 are made of a PFA resin is not produced.

Furthermore, although the bending elastic modulus of the coating films 106 and 126 is set to 0.7 GPa or less in the above exemplary embodiment, a bending elastic modulus of a coating film may be larger than 0.7 GPa. Although the effect produced by setting the bending elastic modulus of the coating films 106 and 126 to 0.7 GPa or less is not produced, a bending elastic modulus of a coating film is smaller and an output image is less deteriorated in a case where the coating films 106 and 126 are made of a PFA resin than in a case where a coating film is made of a PI resin.

Roller resistance of the holding roller 34 is not mentioned in particular in the above exemplary embodiment but is desirably not less than $10^{-7}\Omega$ and less than $10^{9}\Omega$ in consideration of occurrence of a transfer defect caused by a voltage defect occurring between the photoconductor 38 and the holding roller 34.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a draw-up member that draws a liquid developer containing oil and toner up from a storage part in which the liquid developer is stored while rotating;

a cylindrical member that is disposed so as to face the draw-up member, receives the liquid developer from the draw-up member while rotating, and has a circumferential surface on which a film of the liquid developer is formed, the cylindrical member having an elastic part having a circular cross section and a coating film that covers the elastic part and is made of a copolymer of tetrafluoroethylene and perfluoroalkyl vinyl ether; and a formation member having a circumferential surface on which an image is formed by the liquid developer received by the cylindrical member, wherein a thickness of the coating film is not less than 40 μm and not more than 150 μm.

2. An image forming apparatus comprising:

a cylindrical member that has a circumferential surface on which an image formed by a liquid developer containing oil and toner is formed while the cylindrical member is rotating, the cylindrical member having an elastic part having a circular cross section and a coating film that covers the elastic part and is made of a copolymer of tetrafluoroethylene and perfluoroalkyl vinyl ether; and a transfer member that transfers the image formed on the circumferential surface of the cylindrical member onto a recording medium, wherein a thickness of the coating film is not less than 40 μm and not more than 150 μm.

3. The image forming apparatus according to claim 1, wherein a bending elastic modulus of the coating film is 0.7 GPa or less.

4. The image forming apparatus according to claim 2, wherein a bending elastic modulus of the coating film is 0.7 GPa or less.

5. The image forming apparatus according to claim 1, further comprising a removing member that makes contact with the circumferential surface of the cylindrical member and removes the liquid developer remaining on the circumferential surface of the cylindrical member, wherein the removing member and the circumferential surface of the cylindrical member are in contact with each other so that the liquid developer remaining on the circumferential surface of the cylindrical member does not pass between the removing member and the circumferential surface of the cylindrical member and does not remain on the circumferential surface of the cylindrical member.

6. The image forming apparatus according to claim 2, further comprising a removing member that makes contact with the circumferential surface of the cylindrical member and removes the liquid developer remaining on the circumferential surface of the cylindrical member, wherein the removing member and the circumferential surface of the cylindrical member are in contact with each other so that the liquid developer remaining on the circumferential surface of the cylindrical member does not pass between the removing member and the circumferential surface of the cylindrical member and does not remain on the circumferential surface of the cylindrical member.

7. The image forming apparatus according to claim 5, wherein the removing member has a plate shape;

an end of the removing member is in contact with the circumferential surface of the cylindrical member, and a setting angle between the removing member and the cylindrical member viewed from an axial direction of the cylindrical member is not less than 35 degrees and not more than 45 degrees.

8. The image forming apparatus according to claim 6, wherein the removing member has a plate shape;

an end of the removing member is in contact with the circumferential surface of the cylindrical member, and a setting angle between the removing member and the cylindrical member viewed from an axial direction of the cylindrical member is not less than 35 degrees and not more than 45 degrees.

9. The image forming apparatus according to claim 5, wherein filtered maximum waviness of the cylindrical member is 2.0 μm or less.

10. The image forming apparatus according to claim 6, wherein filtered maximum waviness of the cylindrical member is 2.0 μm or less.

11. An image forming apparatus comprising:

a draw-up member that draws a liquid developer containing oil and toner up from a storage part in which the liquid developer is stored while rotating;

a first cylindrical member that is disposed so as to face the draw-up member, receives the liquid developer from the draw-up member while rotating, and has a circumferential surface on which a film of the liquid developer is formed, the first cylindrical member having an elastic part having a circular cross section and a coating film that covers the elastic part and is made of a copolymer of tetrafluoroethylene and perfluoroalkyl vinyl ether;

a formation member having a circumferential surface on which an image is formed by the liquid developer received by the cylindrical member;

a second cylindrical member that has a circumferential surface on which an image formed by a liquid developer containing oil and toner is formed while the second cylindrical member is rotating, the second cylindrical member having an elastic part having a circular cross section and a coating film that covers the elastic part and is made of a copolymer of tetrafluoroethylene and perfluoroalkyl vinyl ether; and a transfer member that transfers the image formed on the circumferential surface of the second cylindrical member onto a recording medium, wherein a thickness of the coating film on the first cylindrical member and the second cylindrical member is not less than 40 μm and not more than 150 μm.

12. An image forming apparatus comprising:

a cylindrical member that has a circumferential surface on which an image formed by a liquid developer containing oil and toner is formed while the cylindrical member is rotating, the cylindrical member having an elastic part having a circular cross section and a coating film that covers the elastic part and is made of a copolymer of tetrafluoroethylene and perfluoroalkyl vinyl ether;

a transfer member that transfers the image formed on the circumferential surface of the cylindrical member onto a recording medium; and a removing member that makes contact with the circumferential surface of the cylindrical member and removes the liquid developer remaining on the circumferential surface of the cylindrical member, wherein the removing member and the circumferential surface of the cylindrical member are in contact with each other so that the liquid developer remaining on the circumferential surface of the cylindrical member does not pass between the removing member and the circumferential surface of the cylindrical member and does not remain on the circumferential surface of the cylindrical member.

* * * * *